US006343581B2

(12) United States Patent
Suzuki

(10) Patent No.: US 6,343,581 B2
(45) Date of Patent: Feb. 5, 2002

(54) VARIABLE VALVE TIMING AND LIFT STRUCTURE FOR FOUR CYCLE ENGINE

(75) Inventor: Atsushi Suzuki, Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/681,878

(22) Filed: Jun. 20, 2001

(51) Int. Cl.[7] ..... F01L 1/34

(52) U.S. Cl. ..... 123/90.17; 123/90.15; 123/90.16; 123/90.6

(58) Field of Search ..... 123/90.17, 90.15, 123/90.16, 90.18, 90.27, 90.31, 90.6, 188.2

(56) References Cited

U.S. PATENT DOCUMENTS 4,690,110 A * 9/1987 Nishimura et al. ..... 123/90.17
4,807,574 A * 2/1989 Shibata et al. ..... 123/90.17
4,854,273 A * 8/1989 Uesugi et al. ..... 123/90.17
4,887,563 A * 12/1989 Ishida et al. ..... 123/90.16
4,926,804 A * 5/1990 Fukuo ..... 123/90.16
RE33,411 E * 10/1990 Inoue et al. ..... 123/90.17
5,020,488 A * 6/1991 Watanabe ..... 123/90.16
RE34,553 E * 3/1994 Konno ..... 123/90.17
RE34,596 E * 5/1994 Masuda et al. ..... 123/90.16
5,564,373 A * 10/1996 Hara ..... 123/90.16
5,836,274 A * 11/1998 Saito et al. ..... 123/90.16
5,855,190 A * 1/1999 Matsunaga ..... 123/90.17
6,216,655 B1 * 4/2001 Yoshiki et al. ..... 123/90.15

* cited by examiner

*Primary Examiner*—Teresa Walberg
*Assistant Examiner*—Fadi H. Dahbour
(74) *Attorney, Agent, or Firm*—Ernest A. Beutler

(57) ABSTRACT

A variable valve timing and lift structure for a four-cycle internal combustion engine wherein a high speed and low speed cam are associated with the camshaft, each for operating the same valve. The high speed cam is supported for movement relative to the camshaft and this movement includes relative rotation. A coupling device selectively couples the second cam for rotation with the camshaft so as to operate the valve during at least a portion of its opening and closing movement when so coupled. When the second cam is not so coupled, the first cam controls the entire motion of the valve. The first and second cams are related so that at least one of these cams can operate two adjacent valves for the same cylinder, thus simplifying the overall construction.

22 Claims, 7 Drawing Sheets

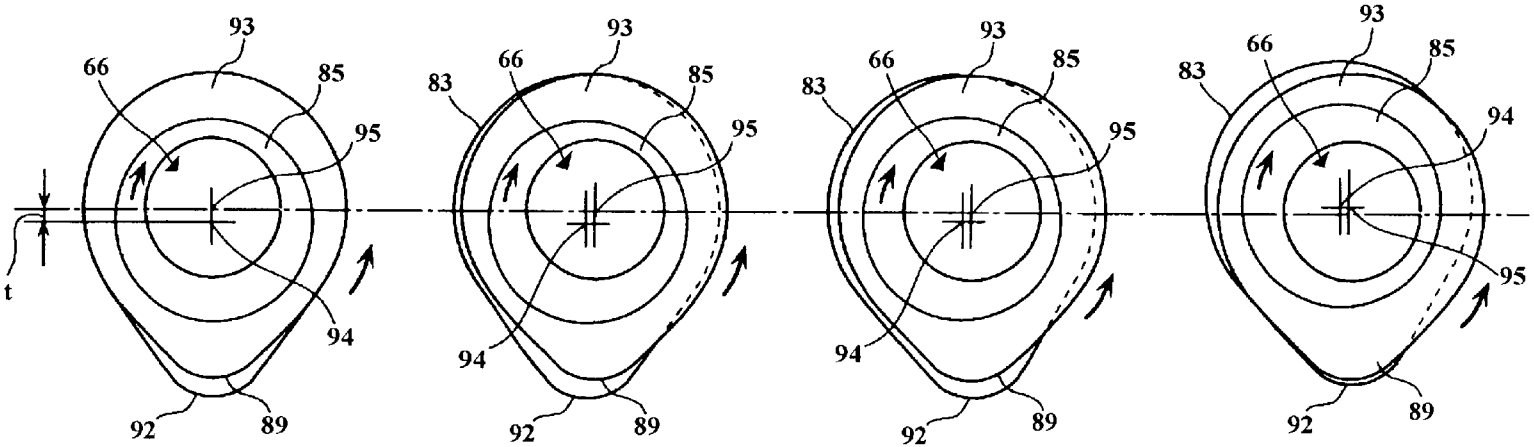
FIG. 17
FIG. 18
FIG. 19
FIG. 20
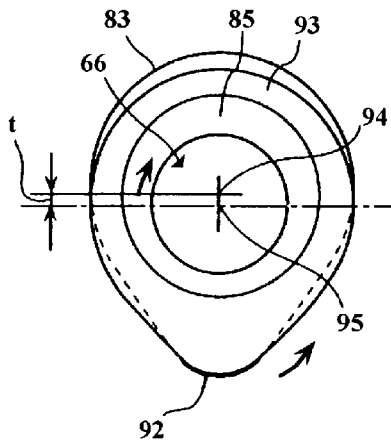
FIG. 21
FIG. 22
FIG. 23

VARIABLE VALVE TIMING AND LIFT STRUCTURE FOR FOUR CYCLE ENGINE

BACKGROUND OF INVENTION

This invention relates to an internal combustion engine and more particularly to variable valve timing and lift arrangement for such engines. It has been recognized that the performance of an internal combustion engine can be improved throughout the entire running range if a variable valve timing and lift arrangement is employed in connection with the engine. By changing the valve opening characteristics during engine running, it is possible to optimize the valve timing and lift for each running condition.

One way this has been done is by providing a first cam and a second cam that rotate together and wherein one of the cams is moved to a retracted position during the rotation so that the other can controls the valve operation during one engine running phase. By shifting the normally disabled cam to an engaged or operative position, it is possible to then change the timing and lift characteristics. However, the types of mechanisms that have been proposed for this purpose are quite complicated and subject to difficulty in operation and transition from one phase to the other.

It, therefore, a principal object to this invention to provide an improved variable valve timing and lift arrangement for an internal combustion engine.

It is further object to this invention to provide a variable valve timing and lift mechanism employing two different cams, each of which is operative to control the valve timing during a specific engine running condition with the running conditions controlled by each cam being different.

It is a further object to this invention to provide an improved variable valve timing mechanism of the type set forth in the preceding paragraph wherein the transition can be made easily and at any time during the engine running characteristics.

It is a further object to this invention to provide an improved variable valve timing mechanism for an internal combustion engine wherein the number of components required operating a plurality of valves is reduced.

SUMMARY OF INVENTION

One feature of the invention is adapted to be embodied in an internal combustion engine that has a combustion chamber. At least one gas flow passage communicates with the combustion chamber through a valve seat and a poppet valve controls the flow through the valve seat. A camshaft is journalled for rotation about a camshaft axis. A first cam having a first lift characteristic is fixed for rotation with the camshaft. A second cam is associated with the camshaft and has a second lift characteristic different from the first lift characteristic of the first cam. A valve actuator is associated with the first and second cams for transmitting their rotational movements to reciprocation of the poppet valve. A coupling device is provided for selectively permitting relative rotational movement between the camshaft and the second cam so that the first cam controls the entire opening and closing cycle of the poppet valve and for coupling the second cam for rotation with the camshaft about the camshaft axis so that the second cam controls at least a part of the opening and closing operation of the poppet valve.

Another feature of the invention is adapted to be embodied in an internal combustion engine as set forth in the preceding paragraph and wherein a second poppet valve is provided for opening and closing a second valve seat in the combustion chamber and a third cam. The cams are juxtaposed axially on the camshaft and one of the first and second cams have portions for controlling the opening and closing cycles of both of the poppet valves. The other of the first and second cams controls at least a portion of the opening and closing of only one of the poppet valves and the third cam controls at least a portion of the opening and closing cycle of the other of the poppet valves.

BRIEF DESCRIPTION OF DRAWINGS

FIG. 2 is a view looking in the direction perpendicular to the plane about which FIG. 1 is taken and shows the valves associated with the intake side of two cylinders of the cylinder head.

FIGS. 17 through 23 are cross sectional views, in part similar to those of FIGS. 10 through 16, and show how the eccentric bearing support for the high speed cam permits it to move in a radial direction so that it will not effect the operation of the valve.

DETAILED DESCRIPTION

Figure 1:
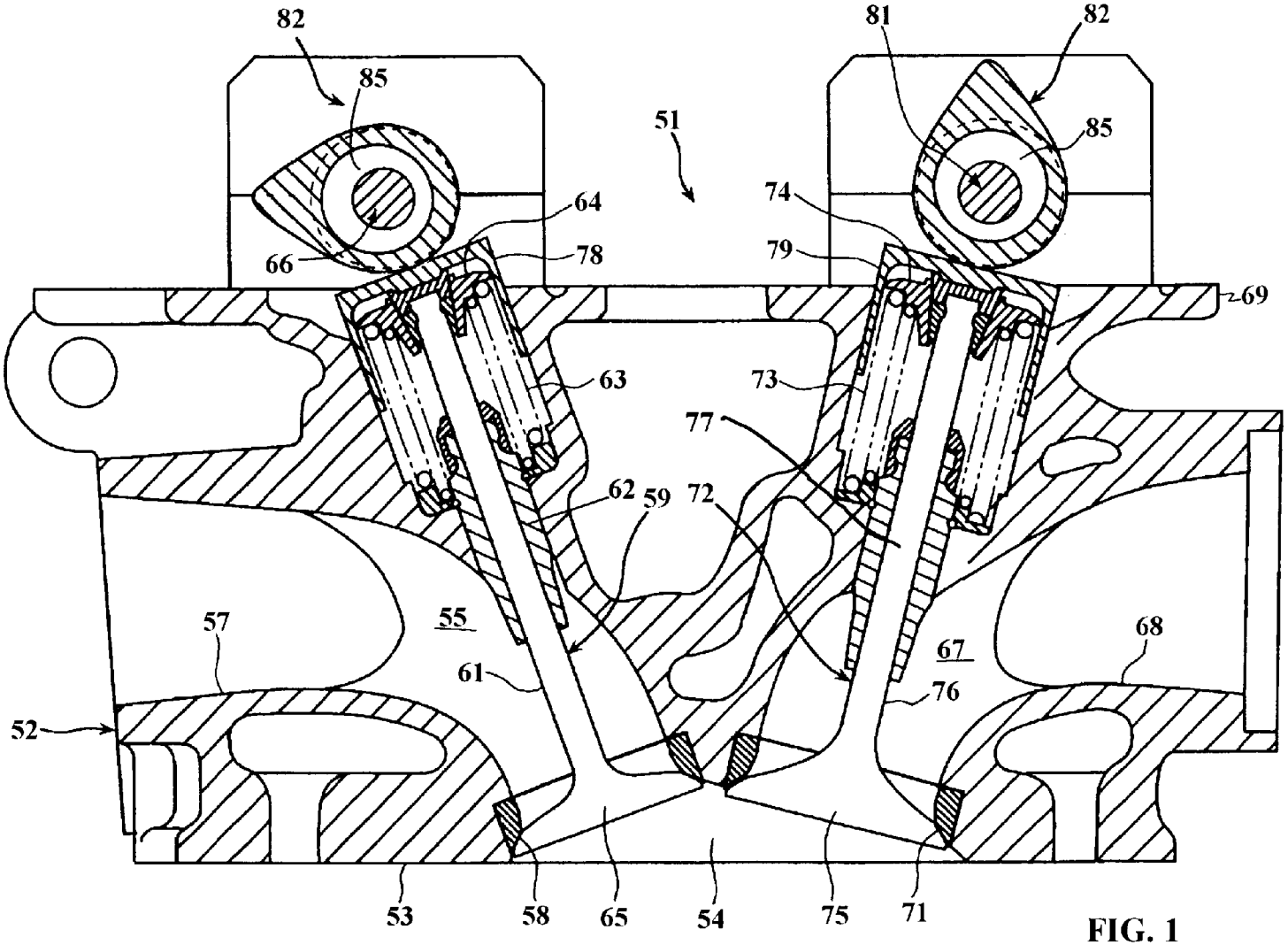
FIG. 1 is a cross sectional view taken through one of the intake valves and one of the exhaust valves seats of a single cylinder of the cylinder head portion of an internal combustion engine constructed in accordance with an embodiment of the invention.
Figure 2:
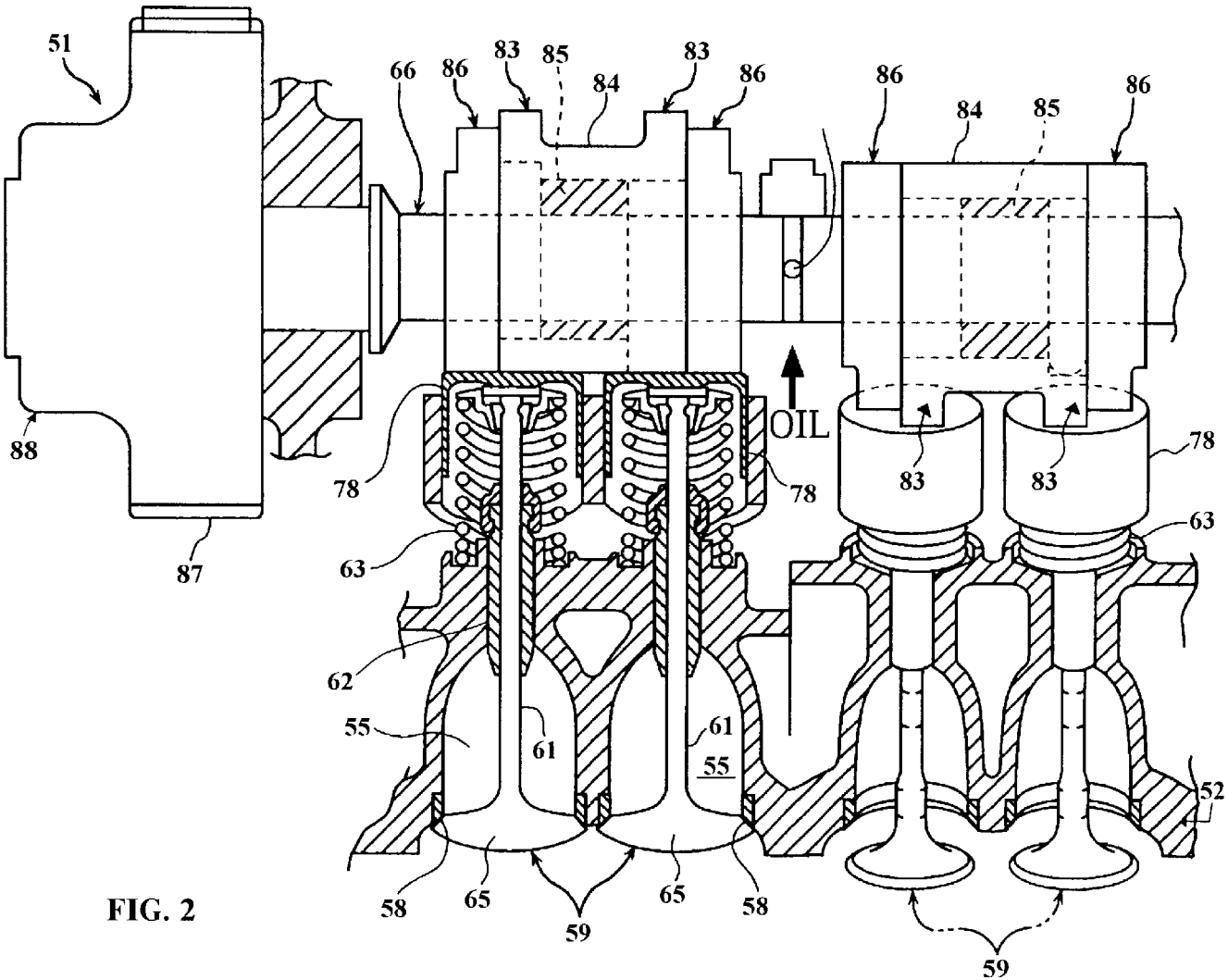

Referring now in detail to the drawings and initially primarily to FIGS. 1 and 2, an internal combustion engine constructed in accordance with an embodiment of the invention is shown in part and is identified generally by the reference numeral 51. Since the invention deals primarily with the actuation for the valves of the engine 51 and since the engine is of the twin overhead cam, four valves per cylinder type, only the cylinder head assembly has been shown in the drawings. It is believed that those skilled in the art will readily understand how to apply this invention to engines having any other type of general construction and incorporating any type of cylinder block, piston and crankshaft arrangement.

The engine 51 is comprised of a main cylinder head member, indicated generally by the reference numeral 52, which has a lower sealing surface 53 that is adapted to be sealingly engaged with an associated cylinder block, which is not shown for the reasons aforenoted. This cylinder head lower sealing surface 53 surrounds a recess 54 which functions to cooperate with the associated cylinder bore and head of the piston to form the combustion chamber of the engine. Since at top dead center the recess 54 defines the major portion of the clearance volume of the cylinder, at times it will be referred to as the "combustion chamber".

A pair of intake passages 55 extend through the cylinder head member 52 from an intake opening formed in an outer surface 56 of one side of the cylinder head member 52. This opening may be a common opening 57 if a Siamese type valve arrangement is chosen. It should be readily apparent, however, that the arrangement can also be utilized with separate intake passages, each having its own opening in the cylinder head outer surface 56.

The intake passages 55 terminate at the combustion chamber surface 54 in valve seats 58 which may be formed as inserts particularly if the main cylinder head member 52 is formed from lightweight material such as aluminum or aluminum alloy. These valve seat inserts may be suitably positioned in the cylinder head member 52, for example by press fitting, metallurgical bonding or the like.

A pair of intake valves indicated generally by the reference numeral 59 and having stem portions 61, are supported for reciprocation in the cylinder head member 52 by respective valve guides 62. These intake valves 59 are urged to their closed positions by means of coil compression spring assemblies 63 that are engaged with keeper retainer assemblies, indicated generally by the reference numeral 64, for urging the valves 59 and specifically the head portions 65 thereof into closed seating relationship with the valve seats 58. These intake valves 59 are opened by an intake camshaft assembly, indicated generally by the reference numeral 66 and which will be described in more detail later.

On the side of the cylinder head member 52 opposite the intake passages 55, there are provided a pair of exhaust passages 67 which, like the intake passages 55 may be Siamese if desired. In that case, these exhaust passages 67, merge to a common opening 68 formed in an outer surface 69 of the cylinder head which is opposed to the cylinder head intake side outer surface 56. The exhaust passages 67 extend from valve seats 71 which are formed in a suitable manner, like the intake valve seats 58.

Poppet type exhaust valves 72 control the opening and closing of the valve seats 71. Like the intake valves 59, the exhaust valves 72 are urged toward their closed positions by coil spring assemblies 73 that operate against keeper retainers 74. This urges heads 75 of the exhaust valves 72 into sealing engagement with the seats 71. Also like the intake valves 59, the exhaust valves 72 have stem portions 76 that are slidably supported in guides 77.

Thimble tappets 78 and 79 are associated with each of the intake valves 59 and exhaust valves 72, respectively. These thimble tappets 78 and 79 transmit motion from the intake camshaft assembly 66 and an exhaust camshaft assembly 81 to the valves 59 and 72 for effecting their opening.

In the illustrated embodiment, a variable valve lift and/or timing arrangement is employed between each of the intake and exhaust camshaft assemblies 66 and 81 and the respective intake and exhaust valves 59 and 72. Because these mechanisms can be the same, only the description of one will be made referring now to the remaining figures and primarily initially to FIG. 2.

Each camshaft assembly 66 and 81 has associated with it a respective cam arrangement, indicated generally by the reference numeral 82 for operating the respective valves. In the illustrated embodiment the cam arrangement 82 is comprised of a pair of high speed cams 83 which are, in the illustrated embodiment, integrally formed with a connecting barrel shape non-cam portion 84. These high speed cams 83 are spaced sufficiently to overlap the respective valve thimble tappets 78 and 79 of both valves for a given cylinder, both in the case of the intake valves 59 and exhaust valves 72.

These high speed cams 83 are journalled on the respective camshaft assemblies 66 or 81 by an intermediate eccentric bearing 85 and may be either coupled for rotation with the respective camshaft assemblies 66 and 81 or rotatable independently of it as will be described shortly. The high speed cams 83 are bounded on their outer peripheries by low speed cams, indicated generally by the reference numeral 86.

The camshaft assemblies 66 and 81 are both driven by a timing drive which includes a respective toothed sprocket 87 that can be driven either by belt, chains or a gear arrangement and which is associated with respective camshaft with a variable valve timing mechanism, indicated generally by the reference numeral 88, for altering the valve timing of both the intake and exhaust valves 59 and 72 in addition to changing their lift characteristics in the manner now to be described by principle reference to FIGS. 3 through 29.

Figure 3:
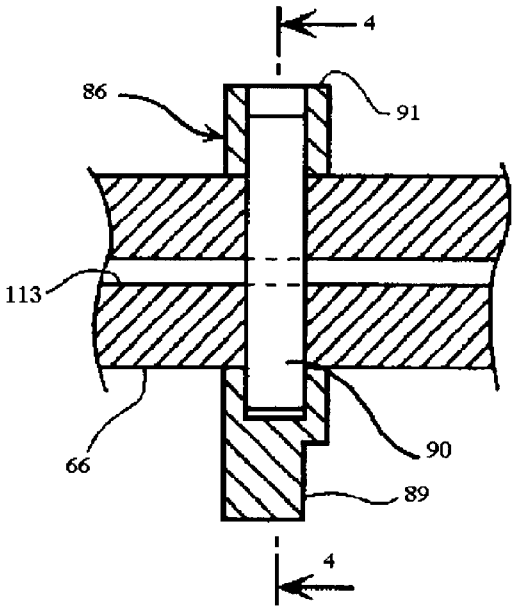
FIG. 3 is an enlarged cross sectional view taken through the axis of the intake camshaft as shown in FIG. 2 as showing the relationship between one of the low speed cams and the camshaft.
Figure 4:
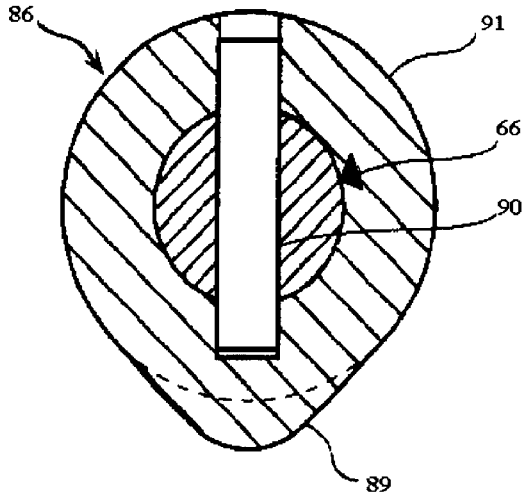
FIG. 4 is a cross sectional view taken along the line 4—4 of FIG. 3.
Figure 5:
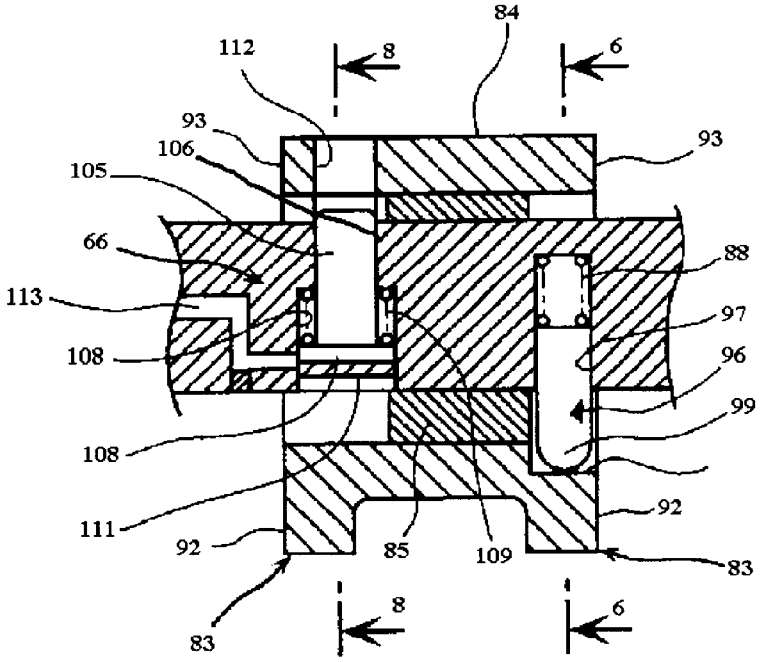
FIG. 5 is a cross sectional view, in part similar to FIG. 3, but shows the relationship between the camshaft and the high speed cams.

Referring first primarily to FIGS. 3 and 4, the low speed cams 86 are comprised of lobe portions 89 which are shaped to provide the appropriate degree of lift and rate of lift and heal portions 91 which provide no lift and permit the associated valves 59 or 72 to be maintained in their closed positions. In the illustrated embodiment, these low speed cams 86 are fixed for rotation with the respective camshaft assemblies 66 or 81 by means of pins 90 which may be pressed or otherwise fit into suitable bores formed in both the cams 86 and respective camshaft assemblies 66 or 81.

The high speed cams 83 are formed with lobes 92 that are configured to provide the appropriate or desired amount of valve lift and also rate of opening and closing of the valve. In the illustrated embodiment, this lift is greater than that of the low speed cams 86 and the timing of opening and closing is also approximately the same as the low speed cams 86 but the rate of opening and closing is higher. Of course, it will be readily apparent to those skilled in the art that other relationship can be chosen between the high speed cams 83 and the low speed cams 86.

In this embodiment, the radius of heel portions 93 of the high speed cams 83 is the same as the heel portions 91 of the low speed cams 86. The high speed cams 83 have an inner bore that is complimentary to a cylindrical outer bore of the eccentric bushings 85. However, the center of this bore, indicated by the point or line 94 in FIGS. 17 through 23 is eccentric to the camshaft axis 95 of the respective camshaft assembly 66 or 81. This eccentricity is indicated by the dimension "t" in FIGS. 17 and 21 depending upon which side of the camshaft axis 95 the high speed camshaft center 94 is displaced to.

The coupling mechanism for controlling the relationship of the high speed cams 83 to the respective camshaft assemblies 66 or 81 includes two components. The first of these components, appear best in FIG. 6 and comprises a locating plunger, indicated by the reference numeral 96 that is slidably supported in a bore 97 of the respective camshaft assemblies 66 or 81 and which is biased by coil compression spring 98. The spring 98 causes its tip portion 99, which is hemispherical, to be received in a machined semi-cylindrical slot 101 formed in the high speed cam 83. This arrangement maintains a roughly approximate relationship between the cam lobe portions 92 and 89 of the high and low speed cams 86 and 83, respectively.

Figure 6:
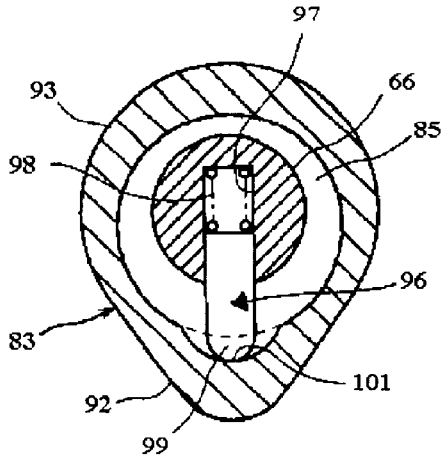
FIG. 6 is a cross sectional view taken along the line 6—6 of FIG. 5.

As may be seen in FIG. 6, this relationship is located axially outwardly of the ends of the eccentric bearing 85 so that this bearing will not have its rotational position interfered with. Also, this relationship further traps the eccentric bearing 85 in the barrel shape non-cam portion 84 of the high speed cams 83.

Figure 7:
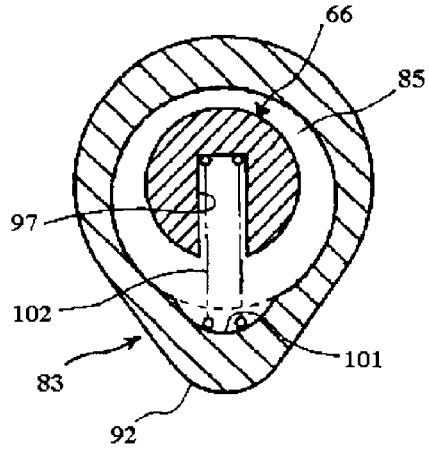
FIG. 7 is a cross sectional view, in part similar to that of FIG. 6, but shows another embodiment of the invention.

Although a plunger, such as the plunger 96 is a preferred relationship, it is not necessary to utilize the plunger as a coil spring of greater length, indicated at 102 in FIG. 7 may also be employed without using a plunger.

As will become apparent later, as long as the high speed cam 83 is not rotatably coupled to the respective camshaft assemblies 66 or 81, it will not control the opening and closing of the associated valves 59 or 72.

At the other axial end of the eccentric bushings 85, there is a provided a locking pin, indicated generally by the reference numeral 104 which performs the function of selectively coupling the high speed cams 83 for rotation with respective camshaft assemblies 66 or 81. This locking pin 104 has a smaller diameter portion 105 that extends through a smaller diameter opening 106 of a counter bored opening formed radially through the respective camshaft assembly 66 or 81.

Figure 8:
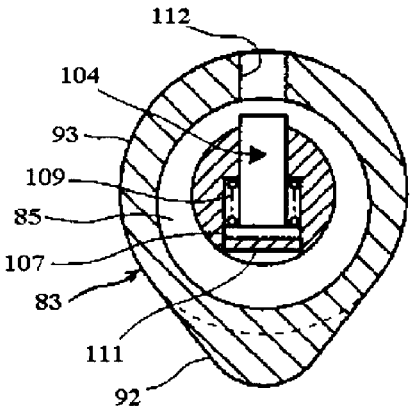
FIG. 8 is a cross sectional taken along the line 8—8 of FIG. 5 and shows the high speed cam in its disengaged non-valve operating position.

A headed portion 107 of these locking pins 104 is received in the larger diameter bore 108 of this counter bore. A light coil compression spring 109 is received in this counter bore 108 and normally urges the locking pin 104 to its released position as shown in FIG. 8. In this position, the headed portion engages a stop 111 that is press fit into the counter bore portion 108.

Figure 9:
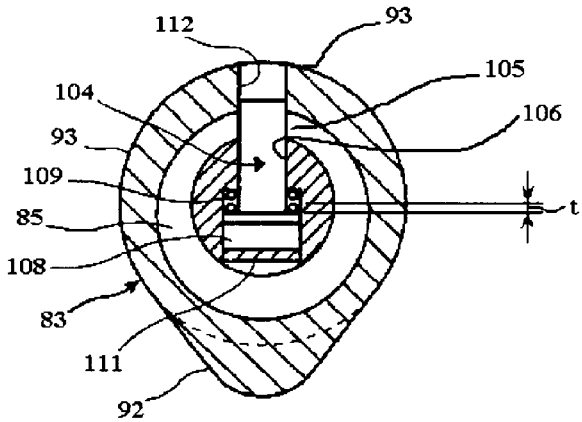
FIG. 9 is a cross sectional view, in part similar to FIG. 8, and shows the high speed cam in its engaged, valve operating position.

When the locking pin 104 is actuated to its locking position as shown in FIG. 9, it will be received in a complimentary counter bore 112 formed in the heel portion 93 of the high speed cams 83. This positioning is done by supplying oil under pressure to the counter bore 108. This pressure is supplied through a supply passage 113 that is drilled axially through the camshaft under a suitable control.

This suitable control operates so as to depressurize the supply passage 113 under low and mid range running conditions so that the low speed cams 86 control the operation of the respective valves 59 or 72. This operation can be best understood by considering FIGS. 10 through 16 and 17 through 23.

Figure 10:
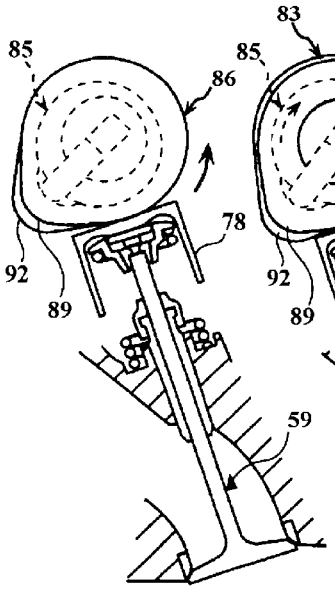
FIGS. 10 through 16 are cross sectional views taken through one of the intake valves and showing the condition when the intake valve is opened and closed solely under the control of the low speed cam.
Figure 11:
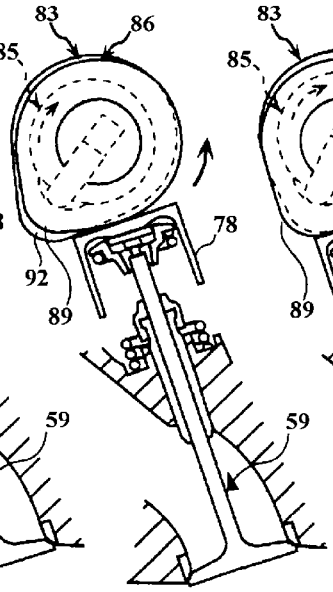
Figure 12:
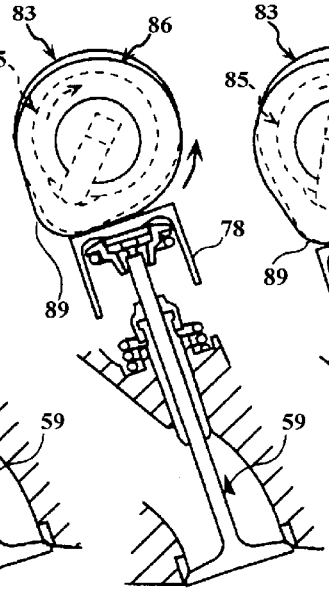
Figure 13:
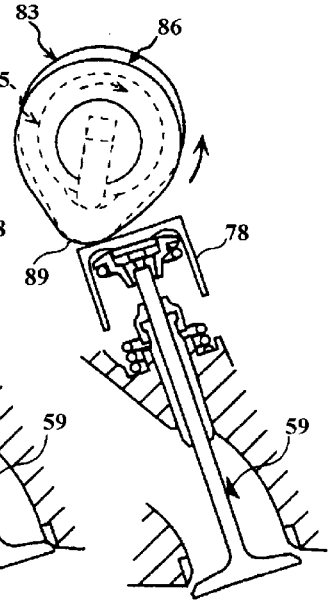
Figure 14:
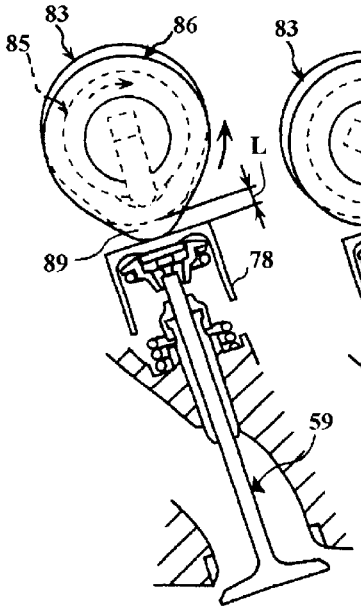
Figure 15:
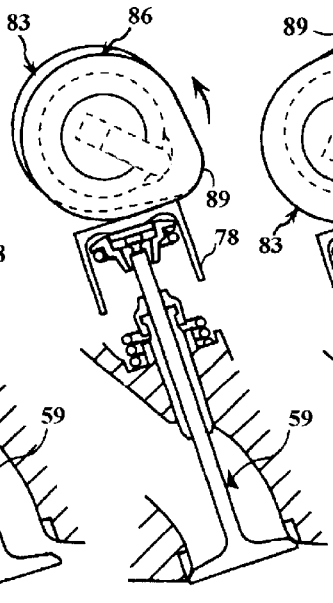
Figure 16:
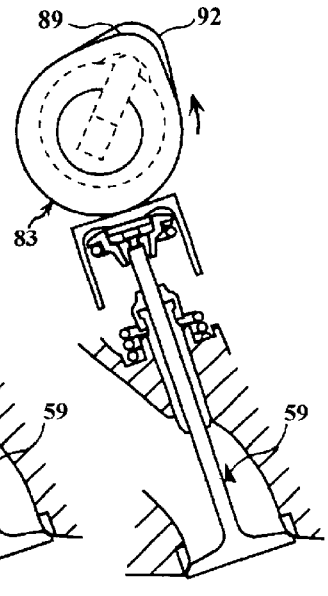
Figure 24:
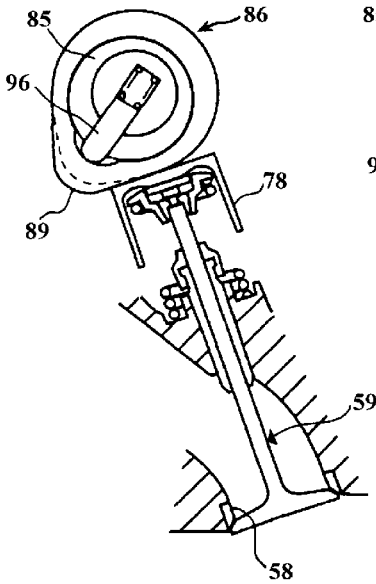
FIGS. 24 through 29 are a sequential series of cross sectional views, in part similar to FIGS. 10 through 16 and show when the high speed cam is controlling the operation of the valve.
Figure 25:
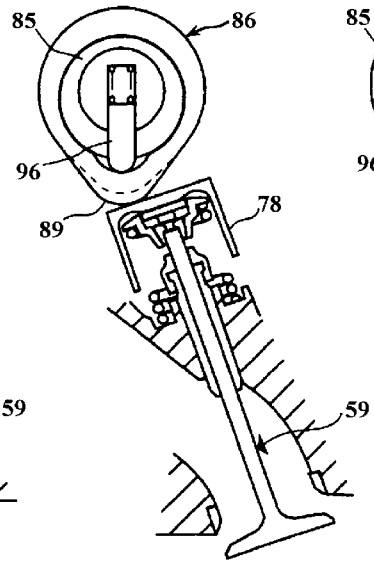
Figure 26:
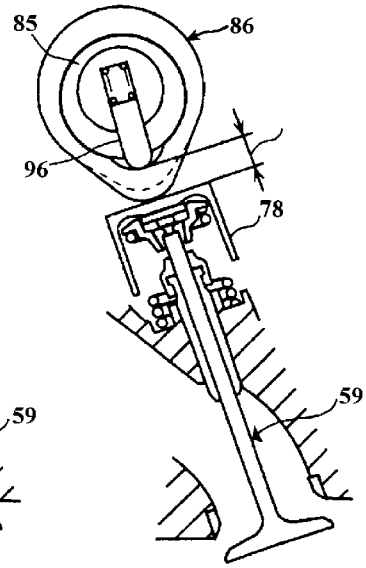
Figure 27:
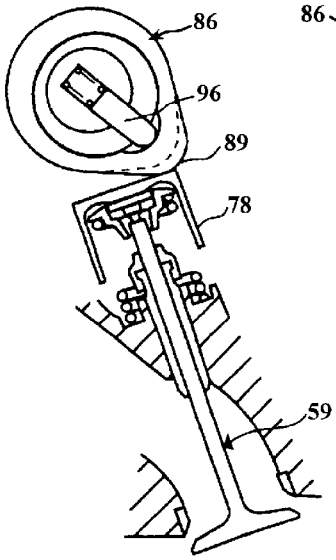
Figure 28:
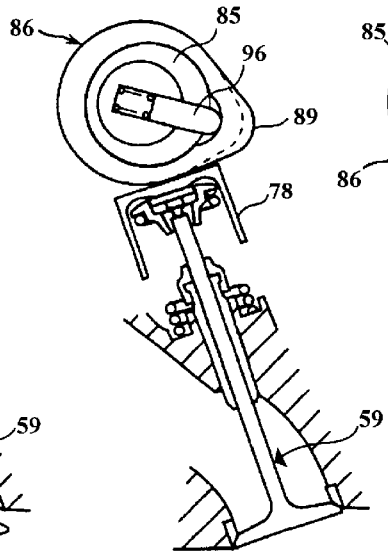
Figure 29:
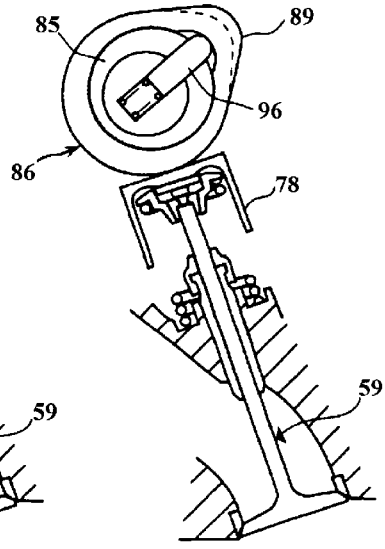

As may be seen in FIGS. 10 and 17, when the respective camshaft, in this case the intake camshaft assemblies 66 rotates sufficiently so that the high speed and low speed cam portions 89 and 92, respectively, engage the thimble tappets 78 on their lift portion, the high speed cam will be permitted to retract slightly by causing rotation of the eccentric bushing 85 in a direction opposite to the direction of camshaft rotation as shown in FIG. 11. When this occurs, the axis 94 of the high speed cam 83 will be displaced as seen in FIG. 18, thus permitting relative rotation between the camshaft assembly 66 and the high speed cam 83.

This condition continues during the lift cycle so that the high speed cam 83 will continue be retracted and only the low speed cam 86 will operate the valve. Thus, although the angular position of the high speed cam 83 relative to the low speed cam 86 will be maintained relatively constant, the high speed cams 83 and specifically their lobe portions 92 will not effect any movement of the valve. That is, at maximum lift the lobe 92 of the high speed cam 83 retracts the distance L (See FIG. 14). As seen in these figures, this operation continues through the complete rotation of the intake camshaft assembly 66 and can repeat as long as the fluid passageways 113 are not actuated.

When the control, however, determines to effect high speed cam operation, then the fluid passageway 113 is activated and the locking pin 104 will move to its engaged position as shown in FIG. 9 and the high speed cam 83 will be coupled for rotation with the respective camshaft assemblies 66 or 81. Under this condition, the lift characteristics will be as set forth in FIGS. 24 through 29 wherein the high speed cam lobe portion 92 will control the opening movement of the respective valve.

Under this condition, the low speed cam 86 does not contact the associated thimble tappet 78 or 79 and hence, will not effect the valve position unless this portion has a part that extends beyond that of the high speed cam lobe portion 92, which is not the case in this embodiment but which may be used in some circumstances. That is, it is possible with this arrangement to provide a lift for the high speed operation wherein the low speed cam 86 may cause some initial opening of the valve or may retard its closing depending upon the design choice. However, the maximum lift portion is always controlled by the high speed cam lobe portion 92.

In the illustrated embodiment, the eccentric bushing 85 is permitted to rotate relative to the associated camshaft while the high speed cams 83 are selectively or coupled or uncoupled for rotation with the respective camshaft. Another arrangement is possible where the selective coupling occurs between the camshaft and the eccentric bushing 85. If this is done, then the high speed cam will be automatically coupled to the camshaft by its positioning with the eccentric bushing 85.

Therefore, it should be clear from the foregoing description that the described embodiments of the invention provide a very effective and relatively simple way for changing the lift characteristics of a valve during engine running. Of course, the foregoing description is that of preferred embodiments and various changes and modification may be made without departing from the spirit and scope of the invention, as defined by the appended claims.

What is claimed is:

1. An internal combustion engine having a combustion chamber, at least one gas flow passage communicating with said combustion chamber through a valve seat, a poppet valve for controlling the flow through said valve seat, a camshaft journalled for rotation about a camshaft axis, a first cam having a first lift characteristic fixed for rotation with said camshaft, a second cam associated with said camshaft for relative rotation, said second cam has a second lift characteristic different from said first lift characteristic of said first cam, a valve actuator associated with said first and said second cams for transmitting their rotational movements to reciprocation of said poppet valve, and a coupling device for selectively permitting relative movement between said camshaft and said second cam so that said first cam controls the entire opening and closing cycle of said poppet valve and for coupling said second cam for rotation with said camshaft about said camshaft axis so that said second cam controls at least a part of the opening and closing cycle of said poppet valve.

2. An internal combustion engine as set forth in claim 1 wherein the coupling device maintains the angular phase positions of the first and second cams regardless of which cam is controlling the opening and closing cycle of the poppet valve.

3. An internal combustion engine as set forth in claim 1 wherein the maximum valve lift provided by the second cam is greater than that of the first cam.

4. An internal combustion engine as set forth in claim 3 wherein the coupling device maintains the angular phase positions of the first and second cams regardless of which cam is controlling the opening and closing cycle of the poppet valve.

5. An internal combustion engine as set forth in claim 4 wherein the coupling device shifts the axis about which the second cam rotates when the first cam controls the entire opening and closing cycle of the poppet valve so that the second cam does not control the opening and closing cycle of said poppet valve.

6. An internal combustion engine as set forth in claim 1 wherein the coupling device comprises an eccentric bushing having a cylindrical bore coaxially received on the camshaft and an cylindrical outer surface eccentrically disposed to said cylindrical bore and received in a complimentary bore formed in the second cam and a selectively operable lock for coupling one of said eccentric bushing and said second cam for rotation with said camshaft so that both said second cam and said eccentric bushing rotate in unison with said camshaft.

7. An internal combustion engine as set forth in claim 6 wherein the selectively operable lock fixes the second cam for rotation with the camshaft.

8. An internal combustion engine as set forth in claim 6 wherein the coupling device further maintains the angular phase positions of the first and second cams regardless of which cam is controlling the opening and closing cycle of the poppet valve.

9. An internal combustion engine as set forth in claim 8 wherein the portion of the coupling device that maintains the angular phase positions of the first and second cams regardless of which cam is controlling the opening and closing cycle of the poppet valve comprises a resiliently biased member engaged between the camshaft and said second cam.

10. An internal combustion engine as set forth in claim 9 wherein the selectively operable lock is operative to axially limit the movement of the eccentric bushing relative to the camshaft in at least one axial direction.

11. An internal combustion engine as set forth in claim 10 wherein the resiliently biased member is operative to axially limit the movement of the eccentric bushing relative to the camshaft in an axial direction opposite to the axial direction controlled by the selectively operable lock.

12. An internal combustion engine as set forth in claim 6 wherein the selectively operable lock is operative to axially limit the movement of the eccentric bushing relative to the camshaft in at least one axial direction.

13. An internal combustion engine as set forth in claim 1 wherein the first cam and the second cam are juxtaposed axially on the camshaft.

14. An internal combustion engine as set forth in claim 6 wherein the first cam and the second cam engage adjacent surfaces of a common follower for transmitting their rotational movements to reciprocation of said poppet valve.

15. An internal combustion engine as set forth in claim 1 further including a second poppet valve for opening and closing a second valve seat in the combustion chamber and a third cam and wherein the cams are juxtaposed axially on the camshaft and one of said first and said second cams has cam portions for controlling the opening and closing cycle of both of said poppet valves, the other of said first and second cams controlling the opening and closing cycle of only one of said poppet valves and said third cam controls at least a portion of the opening and closing cycle of the other of said poppet valves.

16. An internal combustion engine as set forth in claim 15 wherein the cam having the cam portions for controlling the opening and closing cycle of both of the poppet valves comprises the second cam.

17. An internal combustion engine as set forth in claim 16 wherein the coupling device comprises an eccentric bushing having a cylindrical bore coaxially received on the camshaft and an cylindrical outer surface eccentrically disposed to said cylindrical bore and received in a complimentary bore formed in the second cam and a selectively operable lock for coupling one of said eccentric bushing and said second cam for rotation with said camshaft so that both said second cam and said eccentric bushing rotate in unison with said camshaft.

18. An internal combustion engine as set forth in claim 17 wherein the selectively operable lock fixes the second cam for rotation with the camshaft.

19. An internal combustion engine as set forth in claim 18 wherein the coupling device further maintains the angular phase positions of the first and second cams regardless of which cam is controlling the opening and closing cycle of the poppet valve.

20. An internal combustion engine as set forth in claim 19 wherein the portion of the coupling device that maintains the angular phase positions of the first and second cams regardless of which cam is controlling the opening and closing cycle of the poppet valve comprises a resiliently biased member engaged between the camshaft and said second cam.

21. An internal combustion engine as set forth in claim 19 wherein the selectively operable lock is operative to axially limit the movement of the eccentric bushing relative to the camshaft in at least one axial direction.

22. An internal combustion engine as set forth in claim 21 wherein the resiliently biased member is operative to axially limit the movement of the eccentric bushing relative to the camshaft in an axial direction opposite to the axial direction controlled by the selectively operable lock.

* * * * *

US006343581C1

(12) EX PARTE REEXAMINATION CERTIFICATE (5850th)

United States Patent

Suzuki

(10) Number: US 6,343,581 C1

(45) Certificate Issued: Aug. 7, 2007

(54) VARIABLE VALVE TIMING AND LIFT STRUCTURE FOR FOUR CYCLE ENGINE

(75) Inventor: Atsushi Suzuki, Iwata (JP)

(73) Assignee: Yamaha Hatsudoki Kabushiki Kaisha, Iwata (JP)

Reexamination Request:
No. 90/006,604, Apr. 17, 2003

Reexamination Certificate for:

| | |
|---|---|
| Patent No.: | **6,343,581** |
| Issued: | **Feb. 5, 2002** |
| Appl. No.: | **09/681,878** |
| Filed: | **Jun. 20, 2001** |

(30) Foreign Application Priority Data

Jul. 5, 2000 (JP) ..... 2000-203279

(51) Int. Cl.
*F01L 1/34* (2006.01)

(52) U.S. Cl. ..... 123/90.17; 123/90.15; 123/90.16; 123/90.6

(58) Field of Classification Search ..... 74/568 R, 74/567; 123/90.17, 90.6, 90.15, 90.16, 90.18, 123/90.27, 90.31; 29/888.1
See application file for complete search history.

(56) References Cited

U.S. PATENT DOCUMENTS 5,404,770 A * 4/1995 Kruger ..... 74/568 R
5,553,584 A * 9/1996 Konno ..... 123/90.16
5,813,377 A * 9/1998 Matsunaga ..... 74/568 R
5,855,190 A 1/1999 Matsunaga

FOREIGN PATENT DOCUMENTS

| | | |
|---|---|---|
| JP | 06241010 | 8/1994 |
| JP | 06307216 | 11/1994 |

OTHER PUBLICATIONS

European Search Report dated Nov. 29, 2001 w/Japanese Abstracts of listed Japanese references.

* cited by examiner

*Primary Examiner*—Thomas Denion

(57) ABSTRACT

A variable valve timing and lift structure for a four-cycle internal combustion engine wherein a high speed and low speed cam are associated with the camshaft, each for operating the same valve. The high speed cam is supported for movement relative to the camshaft and this movement includes relative rotation. A coupling device selectively couples the second cam for rotation with the camshaft so as to operate the valve during at least a portion of its opening and closing movement when so coupled. When the second cam is not so coupled, the first cam controls the entire motion of the valve. The first and second cams are related so that at least one of these cams can operate two adjacent valves for the same cylinder, thus simplifying the overall construction.

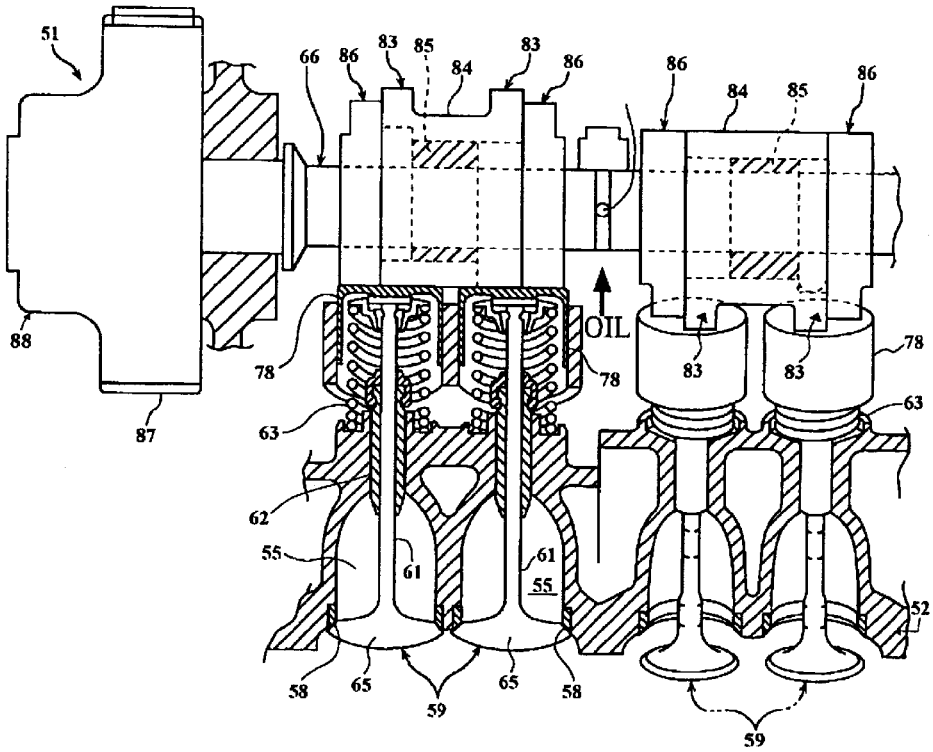

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2, 3, 4, 5, 13, 15 and 16 are cancelled.

Claims 6 and 17 are determined to be patentable as amended.

Claims 7–12, 14 and 18–22, dependent on an amended claim, are determined to be patentable.

6. An internal combustion engine [as set forth in claim 1 wherein the] *having a combustion chamber, at least one gas flow passage communicating with said combustion chamber through a valve seat, a poppet valve for controlling the flow through said valve seat, a camshaft journalled for rotation about a camshaft axis, a first cam having a first lift characteristic fixed for rotation with said camshaft, a second cam associated with said camshaft for relative rotation, said second cam has a second lift characteristic different from said first lift characteristic of said first cam, a valve actuator associated with said first and said second cams for transmitting their rotational movements to reciprocation of said poppet valve, and a coupling device for selectively permitting relative movement between said camshaft and said second cam so that said first cam controls the entire opening and closing cycle of said poppet valve and for coupling said second cam for rotation with said camshaft about said camshaft axis so that said second cam controls at least a part of the opening and closing cycle of said poppet valve, said* coupling device [comprises] *comprising* an eccentric bushing having a cylindrical bore coaxially received on [the] *said* camshaft and an cylindrical outer surface eccentrically disposed to said cylindrical bore and received in a complimentary bore formed in [the] *said* second cam and a selectively operable lock for coupling one of said eccentric bushing and said second cam for rotation with said camshaft so that both said second cam and said eccentric bushing rotate in unison with said camshaft.

17. An internal combustion engine [as set forth in claim 16 wherein the] *having a combustion chamber, at least one gas flow passage communicating with said combustion chamber through a valve seat, a poppet valve for controlling the flow through said valve seat, a camshaft journal led for rotation about a camshaft axis, a first cam having a first lift characteristic fixed for rotation with said camshaft, a second cam associated with said camshaft for relative rotation, said second cam has a second lift characteristic different from said first lift characteristic of said first cam, a valve actuator associated with said first and said second cams for transmitting their rotational movements to reciprocation of said poppet valve, and a coupling device for selectively permitting relative movement between said camshaft and said second cam so that said first cam controls the entire opening and closing cycle of said poppet valve and for coupling said second cam for rotation with said camshaft about said camshaft axis so that said second cam controls at least a part of the opening and closing cycle of said poppet valve coupling device comprises an eccentric bushing having a cylindrical bore coaxially received on the camshaft and an cylindrical outer surface eccentrically disposed to said cylindrical bore and received in a complimentary bore formed in the second cam and a selectively operable lock for coupling one of said eccentric bushing and said second cam for rotation with said camshaft so that both said second cam and said eccentric bushing rotate in unison with said camshaft, a second poppet valve for opening and closing a second valve seat in said combustion chamber, a third cam, said cams being juxtaposed axially on said camshaft, one of said first and said second cams having cam portions for controlling the opening and closing cycle of both of said poppet valves, the other of said first and second cams controlling the opening and closing cycle of only one of said poppet valves and said third cam controls at least a portion of the opening and closing cycle of the other of said poppet valves, the cam having the cam portions for controlling the opening and closing cycle of both of said poppet valves comprising said second cam, said* coupling device [comprises] *comprising* an eccentric bushing having a cylindrical bore coaxially received on [the] *said* camshaft and a cylindrical outer surface eccentrically disposed to said cylindrical bore and received in a complimentary bore formed in [the] *said* second cam and a selectively operable lock for coupling one of said eccentric bushing and said second cam for rotation with said camshaft so that both said second cam and said eccentric bushing rotate in unison with said camshaft.

* * * * *